United States Patent [19]

Cantone

[11] Patent Number: 4,932,802

[45] Date of Patent: Jun. 12, 1990

[54] NAIL POLISH BOTTLE COVER HAVING A NAIL POLISH REMOVER DISPENSER

[76] Inventor: Thomas J. Cantone, 86-69 14th Ave., Brooklyn, N.Y. 11228

[21] Appl. No.: 435,345

[22] Filed: Nov. 13, 1989

[51] Int. Cl.[5] ..... A45D 34/04

[52] U.S. Cl. ..... 401/17; 401/23; 401/126; 401/198

[58] Field of Search ..... 401/126, 128, 129, 123, 401/17, 18, 23, 124, 130, 263, 266, 198, 131

[56] References Cited

U.S. PATENT DOCUMENTS

| | | | |
|---|---|---|---|
| 2,517,283 | 8/1950 | Bryant | 401/198 |
| 2,813,289 | 11/1957 | Even | 401/202 |
| 2,841,809 | 7/1958 | Oliver | 401/266 |
| 3,103,032 | 9/1963 | Brenne | 401/17 |
| 3,195,544 | 7/1965 | Politzer | 401/198 X |
| 3,341,884 | 9/1967 | Pryor | 401/17 |
| 4,622,985 | 11/1986 | Jankewitz | 401/198 |

FOREIGN PATENT DOCUMENTS

| | | | |
|---|---|---|---|
| 1092052 | 11/1954 | France | 401/129 |

*Primary Examiner*—Richard J. Johnson

*Attorney, Agent, or Firm*—Michael I. Kroll

[57] ABSTRACT

An improved nail polish bottle cover having a nail polish remover dispenser incorporated therein is provided and consists of a body member having an elongated neck with a chamber within for holding nail polish remover. A nail polish applicator is affixed to and extends away from center of the internally threaded base of the body member so that when it is threaded onto a threaded neck of a standard nail polish bottle the nail polish applicator will extend into the nail polish. A nail polish remover applicator extends from the nail polish remover and through the neck of the body member to be applied to finger nails for removing nail polish. A cap is hinged to top of the body member neck to protect and seal top of the nail polish remover applicator when the cap is closed.

5 Claims, 1 Drawing Sheet

NAIL POLISH BOTTLE COVER HAVING A NAIL POLISH REMOVER DISPENSER

BACKGROUND OF THE INVENTION

1. Field of the Invention

The instant invention relates generally to nail polish bottles and more specifically it relates to an improved nail polish bottle cover having a nail polish remover dispenser incorporated therein.

2. Description of the Prior Art

Numerous nail polish bottles have been provided in prior art that are adapted to include bottle caps with applicators attached thereto so that the caps will seal the nail polish therein while the applicator allows a person to apply the nail polish onto the nails. To remove the nail polish, separate bottles of nail polish remover are required. While these units may be suitable for the particular purpose to which they address, they would not be as suitable for the purposes of the present invention as heretofore described.

SUMMARY OF THE INVENTION

A primary object of the present invention is to provide an improved nail polish bottle cover having a nail polish remover dispenser incorporated therein that will overcome the shortcomings of the prior art devices.

Another object is to provide an improved nail polish bottle cover having a nail polish remover dispenser incorporated therein so that when nail polish is to be removed from the nails the bottle can be inverted, a cap opened and a sponge applicator pressed against the nails to release the nail polish remover.

An additional object is to provide an improved nail polish bottle cover having a nail polish remover dispenser incorporated therein so that the nail polish remover will always be together in one unit with the nail polish bottle.

A further object is to provide an improved nail polish cover having a nail polish remover dispenser incorporated therein that is simple and easy to use.

A still further object is to provide an improved nail polish cover having a nail polish remover dispenser incorporated therein that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
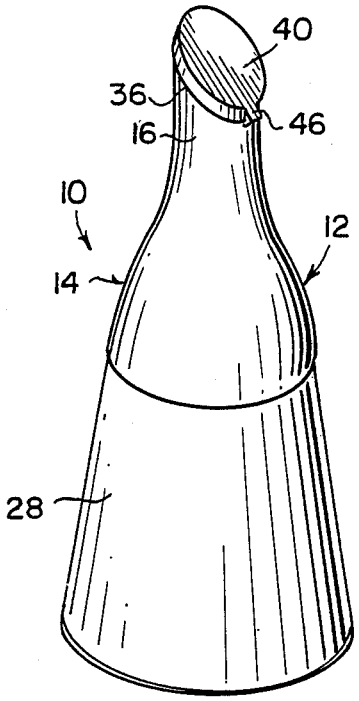
FIG. 1 is a perspective view of the invention with the cap closed, installed onto a standard nail polish bottle.
Figure 2:
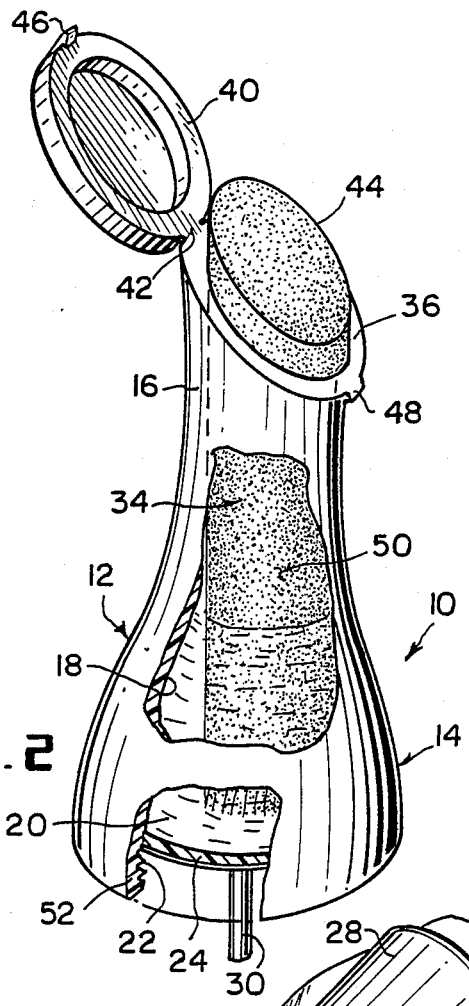
FIG. 2 is a perspective view with parts broken away of the invention with the cap opened, removed from the standard nail polish bottle.
Figure 3:
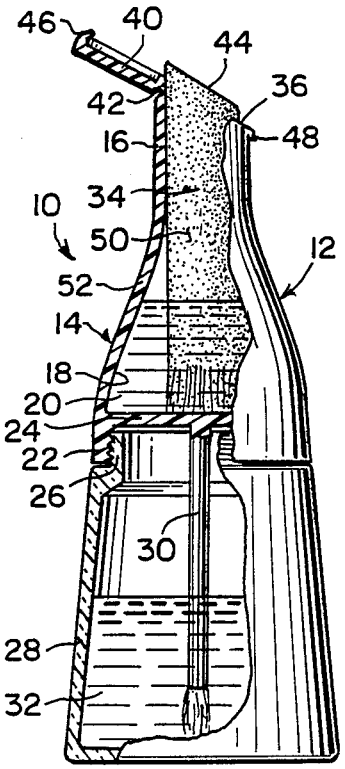
FIG. 3 is an elevational view with parts broken away of the invention with the cap opened, installed onto the standard nail polish bottle.

Turning now descriptively to the drawings, in which similar reference characters denote similar elements throughout the several views, FIGS. 1 through 4 illustrate an improved nail polish bottle cover 10 having a nail polish remover dispenser 12 incorporated therein and consists of a body member 14 having an elongated neck 16 with a chamber 18 within for holding nail polish remover 20 and internal threads 22 within its base 24 so that the body member 14 can thread onto a threaded neck 26 of a standard nail polish bottle 28.

A nail polish applicator 30 is affixed to and extends away from center of the base 24 of the body member 14 so that when the body member 14 is threaded onto the threaded neck 26 of the standard nail polish bottle 28 the nail polish applicator 30 will extend into nail polish 32 in the standard nail polish bottle 28.

A nail polish remover applicator 34 extends from the nail polish remover 20 within the chamber 18 of the body member 14 and through top 36 of the neck 16 of the body member 14 to be applied to fingernails 38 for removing nail polish therefrom. A cap 40 is hinged at 42 to the top 36 of the neck 16 of the body member 14 to protect and seal top 44 of the nail polish remover applicator 34 when the cap 40 is closed.

A latch 46 is formed on the cap 40 and a catch 48 is formed on the top 36 of the elongated neck 16 of the body member 14 for securing the latch 46 when the cap 40 is closed over the top 44 of the nail polish remover applicator 34 when not in use.

Figure 4:
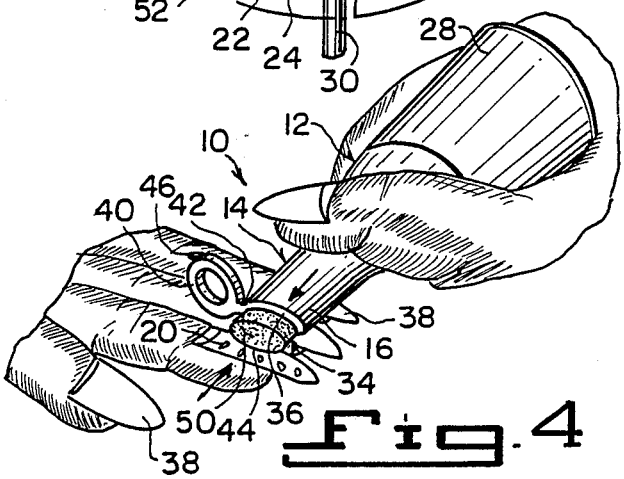
FIG. 4 is a perspective view of the invention with the cap opened, installed onto the standard nail polish bottle being used to remove nail polish from finger nails.

The nail polish remover applicator 34 is formed out of a soft sponge material 50 which when inverted and compressed at the top 44 will allow the nail polish remover 20 to exit therefrom and remove the nail polish from the fingernails 38 (see FIG. 4).

The body member 14, the nail polish applicator 30, the cap 40, the latch 46 and the catch 48 are all integral and fabricated out of durable plastic material 52. The top 36 of the body member neck 16 and the top 44 of the nail polish remover applicator 34 are both slanted so that the top 44 of the nail polish remover applicator 34 can be properly positioned to the fingernails 38 for compression to release the nail polish remover 20.

To use the dispenser 12 a person simply inverts the nail polish bottle 28 along with the cover 10, opens the cap 40 and presses the top 44 of the nail polish remover applicator 34 to the finger nails 38 to release the nail polish remover 20. When the person is finished removing the nail polish the nail polish bottle 28 is turned back to its normal position and the cap 40 is closed.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved nail polish bottle cover having a nail polish remover dispenser incorporated therein comprising:

(a) a body member having an elongated neck with a chamber within for holding nail polish remover and internal threads within its base so that said body member can thread onto a threaded neck of a standard nail polish bottle;

(b) a nail polish applicator affixed to and extending away from the center of said base of said body member so that when said body member is threaded onto the threaded neck of the standard nail polish bottle said nail polish applicator will extend into nail polish in the standard nail polish bottle;

(c) a nail polish remover applicator extending from the nail polish remover within said chamber of said body member and through the top of said neck of said body member to be applied to fingernails for removing nail polish therefrom; and (d) a cap hinged to the top of said neck of said body member to protect and seal the top of said nail polish remover applicator when said cap is closed.

2. An improved nail polish bottle cover as recited in claim 1, further including:

(a) a latch formed on said cap; and (b) a catch formed on the top of said elongated neck of said body member for securing said latch when said cap is closed over the top of said nail polish remover applicator when not in use.

3. An improved nail polish bottle cover as recited in claim 2, wherein said nail polish remover applicator is formed out of a soft sponge material which when inverted and compressed at the top will allow the nail polish remover to exit therefrom and remove the nail polish from the fingernails.

4. An improved nail polish bottle cover as recited in claim 3, wherein said body member, said nail polish applicator, said cap, said latch and said catch are all integral and fabricated out of durable plastic material.

5. An improved nail polish bottle cover as recited in claim 4, wherein the top of said body member neck and the top of said nail polish remover applicator are both slanted so that the top of said nail polish remover applicator can be properly positioned to the fingernails for compression to release the nail polish remover.

* * * * *